US006481434B2

(12) United States Patent
Murdoch

(10) Patent No.: US 6,481,434 B2
(45) Date of Patent: Nov. 19, 2002

(54) GAS FIRED INFRARED RADIANT TUBE HEATING SYSTEM USING PLURAL BURNER ASSEMBLIES AND SINGLE GAS DELIVERY SYSTEM

(75) Inventor: Mark Murdoch, Gasport, NY (US)

(73) Assignee: Roberts-Gordon LLC, Buffalo, NY (US)

( * ) Notice: Subject to any disclaimer, the term of this patent is extended or adjusted under 35 U.S.C. 154(b) by 0 days.

(21) Appl. No.: 10/068,034

(22) Filed: Feb. 5, 2002

(65) Prior Publication Data

US 2002/0083942 A1 Jul. 4, 2002

Related U.S. Application Data

(63) Continuation of application No. 09/554,970, filed as application No. PCT/US98/12528 on Jun. 17, 1998.
(60) Provisional application No. 06/073,231, filed on Nov. 26, 1997.

(51) Int. Cl.[7] ..... F23D 14/12
(52) U.S. Cl. ..... 126/91 A; 431/354
(58) Field of Search ..... 126/91 A, 91 R, 126/104 A, 104 R, 110 C, 110 D, 110 R, 110 B, 116 A; 431/354

(56) References Cited

U.S. PATENT DOCUMENTS 4,905,663 A * 3/1990 Magee ..... 431/354
4,979,491 A * 12/1990 DeMeritt ..... 126/91 A
5,188,288 A * 2/1993 DeMerritt et al. ..... 126/91 A
5,368,010 A * 11/1994 Weber, III et al. ..... 126/110 R
5,429,112 A * 7/1995 Rozzi ..... 126/91 A
5,664,555 A * 9/1997 Maschhoff et al. ..... 126/110 B
5,791,332 A * 8/1998 Thompson et al ..... 126/116 A

* cited by examiner

*Primary Examiner*—Sara Clarke
(74) *Attorney, Agent, or Firm*—John C. Thompson

(57) ABSTRACT

A gas fired infrared radiant heating system of improved thermal output. The present invention solves problems associated with prior art designs by providing a single gas delivery system for delivering combustible gas to two or more burner assemblies. The invention consists of a burner housing (10) with two or more burner assemblies (18), each of which can be connected to a typical radiant tube heat exchanger assembly (12). The burner housing contains a single gas delivery system including a valve (14), a single control circuit module (30), a single blower proving switch (50), and a single manifold (16) which will distribute the gas to the multiple radiant tube heat exchanger assemblies (12). In addition, in positive pressure configurations, the burner housing will also have a single air fan (38), whereas in negative pressure configurations of the heating system one or more exhaust fans may be utilized. The foregoing design will provide a higher thermal output without the heat distribution and installation cost problems of the currently available infrared heaters.

10 Claims, 7 Drawing Sheets

GAS FIRED INFRARED RADIANT TUBE HEATING SYSTEM USING PLURAL BURNER ASSEMBLIES AND SINGLE GAS DELIVERY SYSTEM

CROSS-REFERENCE TO RELATED APPLICATIONS

This application is a continuation-in-part of U.S. patent application Ser. No. 09/554,970, which is in turn a 371 of PCT/US98/12528 filed on Jun. 17, 1998 which claims the benefit of priority of Provisional U.S. patent application Ser. No. 60/073,231 filed Nov. 26, 1997.

TECHNICAL FIELD

The present invention relates generally to gas fired infrared heaters, and more particularly to a gas fired infrared radiant tube heating system which utilizes plural burner assemblies mounted in a common housing along with a single gas valve and a single control circuit module, the flame from each of the plural burner assemblies being forced through an associated radiant tube heat exchanger.

BACKGROUND OF THE INVENTION

Gas fired infrared radiant tube heaters have been developed in many forms. They vary by input, length, size of the radiant tube heat exchanger, also called an radiant pipe or emitter tube, as well as by other factors. Typical prior art patents are U.S. Pat. No. 3,394,886, U.S. Pat. No. 3,416,512, U.S. Pat. No. 5,211,331, EP 0 070 360, GB 2,189,314 A, CA 1,011,314, and GB 2,274,703. These devices are utilized for heating people within a enclosed spaces, for example the space within a building, such as an auditorium, factory building, aircraft hanger, house of worship, vehicle service facility, warehouse, or public hall. Infrared heating has particular application in heating spaces where there are high ceilings. Thus, infrared heating heats from the floor up, greatly reducing heat stratification to the ceiling. Thus there is no need to employ down-draft fans to recover heat lost at the ceiling. In addition, as air temperatures are lower at the ceiling, transmission losses to the outside air are far lower. Infrared heating also has particular application in buildings which have high air change rates, for example aircraft hangers and vehicle service facilities. When the doors to these facilities are opened, most of the warm air is lost to the outside. To reestablish people comfort, if heated with warm air, the interior air volume has to be reheated and driven down from the ceilings. However, if heated with radiant heat, as the floor and surrounding objects are large heat reservoirs, warmth is drawn up and out of the floor, achieving people comfort quickly while larger building spaces may still be at a minimum air temperature. While an infrared heater has particular application for heating people within a fully enclosed space within a building, these heaters have other applications. Thus they may be used to heat people within partially enclosed spaces such as open walkways, grandstands, and tee boxes at golf driving ranges.

There has been an increasing need for heaters with greater thermal output. An infrared radiant tube heater's output capacity is generally limited by the type and size of the tubular heat exchanger connected to it. Thus, there is an effective maximum fueling rate for a radiant pipe of a given diameter and length. A major drawback to the continuing trend of higher thermal output from a single burner assembly is that the heat distribution is generally poor. This is because as fueling rates are increased for radiant pipes of a given diameter and length, hot spots will be created. Unless the building in which such a heater is installed is of sufficient height, there will likely be uncomfortable conditions below the hottest portion of the heat exchanger. The easiest way to solve this problem is to install more heating systems at a lower thermal output thus eliminating the large hot spot from a larger heater and providing more even distribution of the infrared heat. This method causes installation costs to be higher than that of an installation with the higher thermal output burners, as each burner system is provided with its own valve and control circuit module.

OBJECTS AND SUMMARY OF THE INVENTION

It is an object of the present invention to provide a gas fired infrared heater which provides higher thermal outputs without the heat distribution and installation cost problems of the currently available infrared heaters.

More particularly, it is an object of the present invention to provide a gas fired infrared radiant tube heating system for heating an enclosed space, said system including two or more radiant tube heat exchangers, a common burner housing which is connected to the two or more radiant tube heat exchangers, two or more separate burner assemblies carried by the common burner housing, there being one burner assembly interconnected with each of the radiant tube heat exchangers, each burner assembly being capable of firing an associated radiant tube heat exchanger, and a single gas delivery system mounted within the burner housing and connected to a source of combustible gas, the single gas delivery system being interconnected with the two or more separate burner assemblies.

It is a further object of the present invention to provide a system of the type set forth above with a single gas valve assembly.

It is yet another object of the present invention to provide a system of the type set forth above with a single manifold, the manifold having a single inlet and two or more outlets, and wherein each of the burner assemblies is connected to one of the outlets of the single manifold.

It is another object of the present invention to provide a system of the type set forth above with a single control circuit module mounted within the burner housing, the control circuit module monitoring ignition and operation of each of the burner assemblies, and controlling the single gas delivery system.

In accordance with this invention, the problems associated with the prior art and other problems are solved by providing a burner housing capable of igniting and supervising a plurality of gas flames. Thus, the invention consists of a burner housing with two or more burner ports, each of which can be connected to a typical radiant tube heat exchanger assembly. The burner housing will contain a single gas valve, single control circuit module, and multiple blower proving switchs. In addition, in positive pressure configurations it will also have a single air fan. A manifold from the gas valve will distribute the gas to the multiple burner assemblies. The foregoing design will provide a higher thermal output without the heat distribution and installation cost problems of the currently available infrared heaters.

The foregoing objects and advantages of this invention will be more fully understood after a consideration of the following detailed description taken in conjunction with the accompanying drawings in which preferred forms of this invention are illustrated.

DETAILED DESCRIPTION

Figure 1:
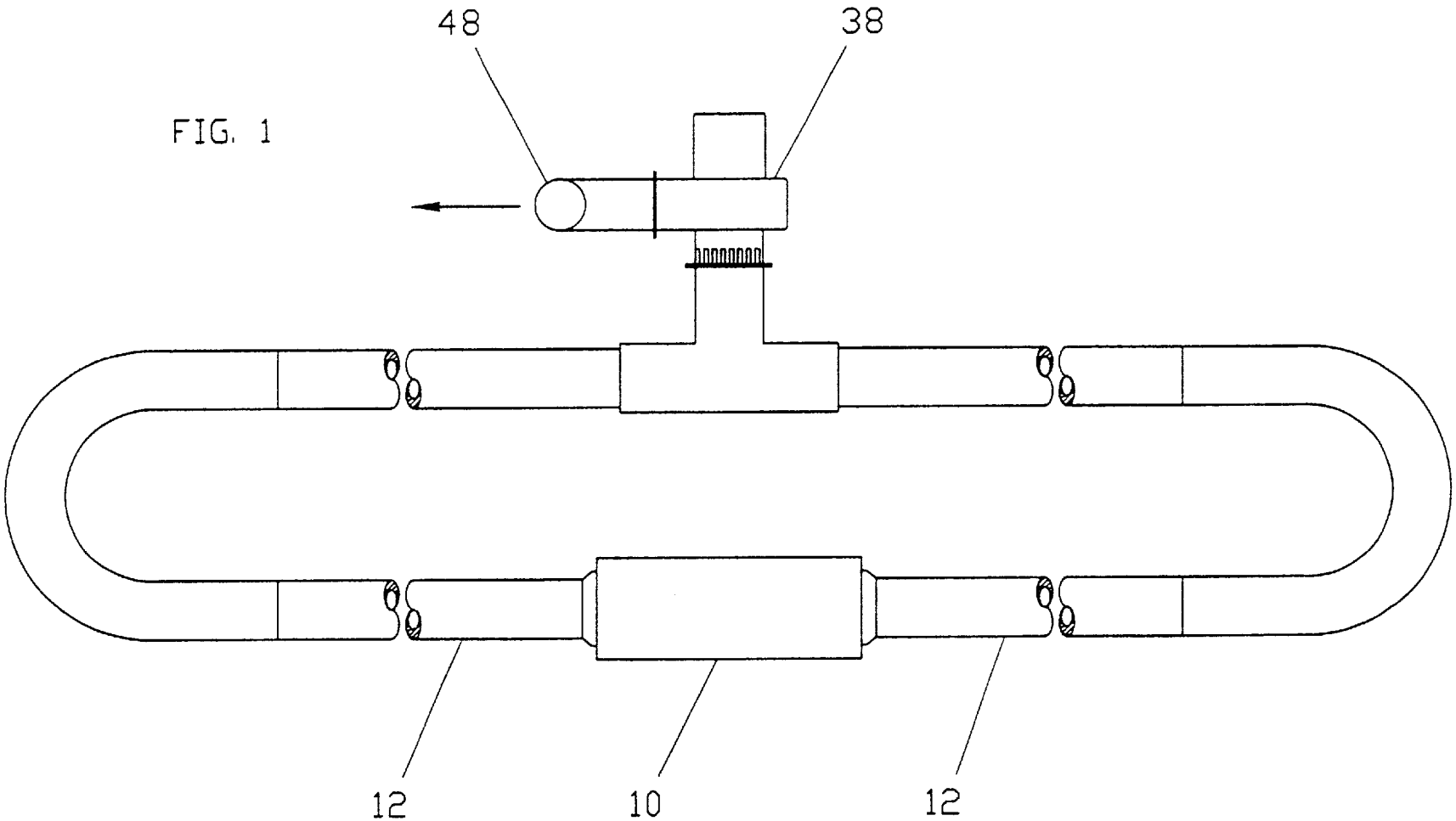
FIG. 1 is a top view of a dual flame radiant tube heating system of this invention utilizing an exhaust fan.
Figure 6:
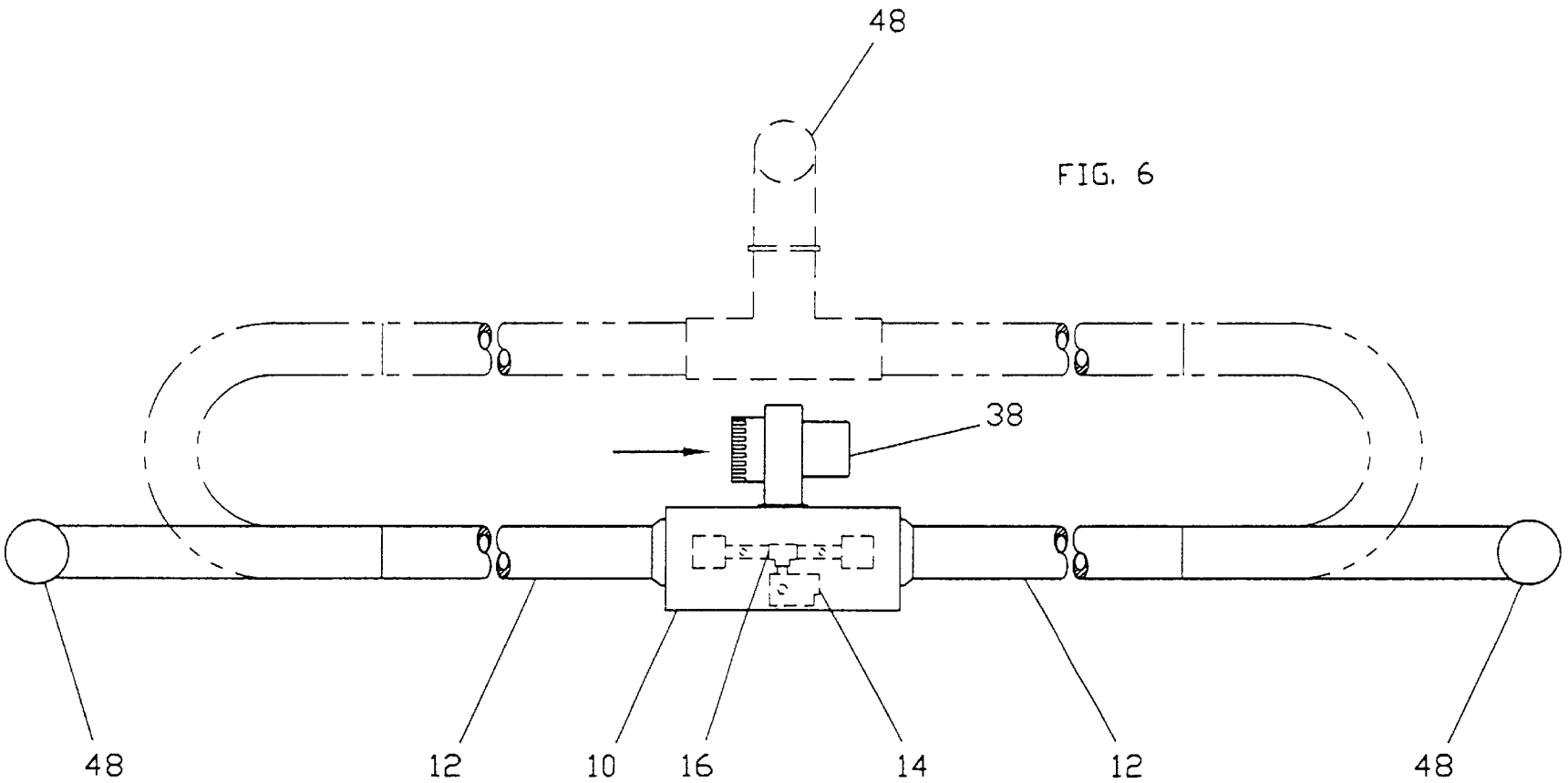
FIG. 6 is a view similar to FIG. 1 but showing the use of a blower fan rather than an exhaust fan, this figure showing in full lines two exhaust stacks and in dotted line a single exhaust stack.
Figure 7:
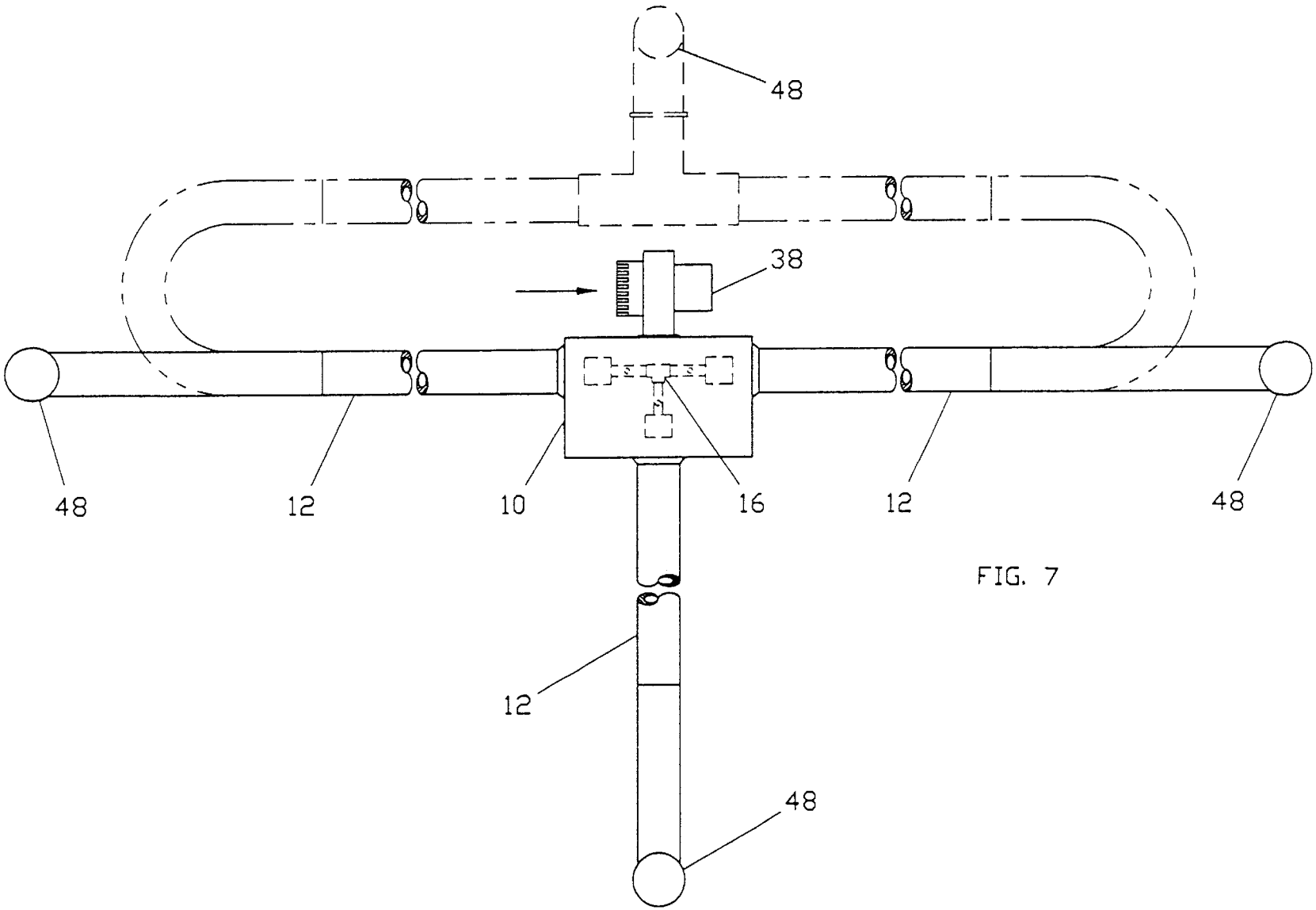
FIG. 7 is a view of a gas fired infrared radiant tube heating system which employs a single gas valve and more than two radiant tube burner assemblies mounted in a single housing, each of the burner assemblies being connected to radiant tubes, this design employing a blower fan.

The heating system of this invention includes a housing 10 to which two or more radiant tube heat exchangers may be connected, two radiant tube heat exchangers 12 being shown in FIGS. 1 and 6, and more than two being shown in FIG. 7. The heat exchangers may be U-shaped as shown in FIG. 1, or they may be straight as shown in full lines in FIG. 6. Each of the heat exchangers is of conventional construction and will typically be mounted below a heat exchanger reflector (not shown), the heat exchanger and reflector being supported from the ceiling of a structure in a conventional manner, (also not shown). In accordance with this invention, the housing 10 is provided with a single gas delivery system including a valve assembly 14, suitable controls which will be described below, and a manifold in the form of T 16, the inlet of the manifold being connected to the discharge side of valve assembly 14. It should be noted that instead of a single T, as shown in FIG. 2, other forms of manifolds may be employed when more than two burner assemblies are connected to the valve assembly 14 as shown in FIG. 7.

Figure 2:
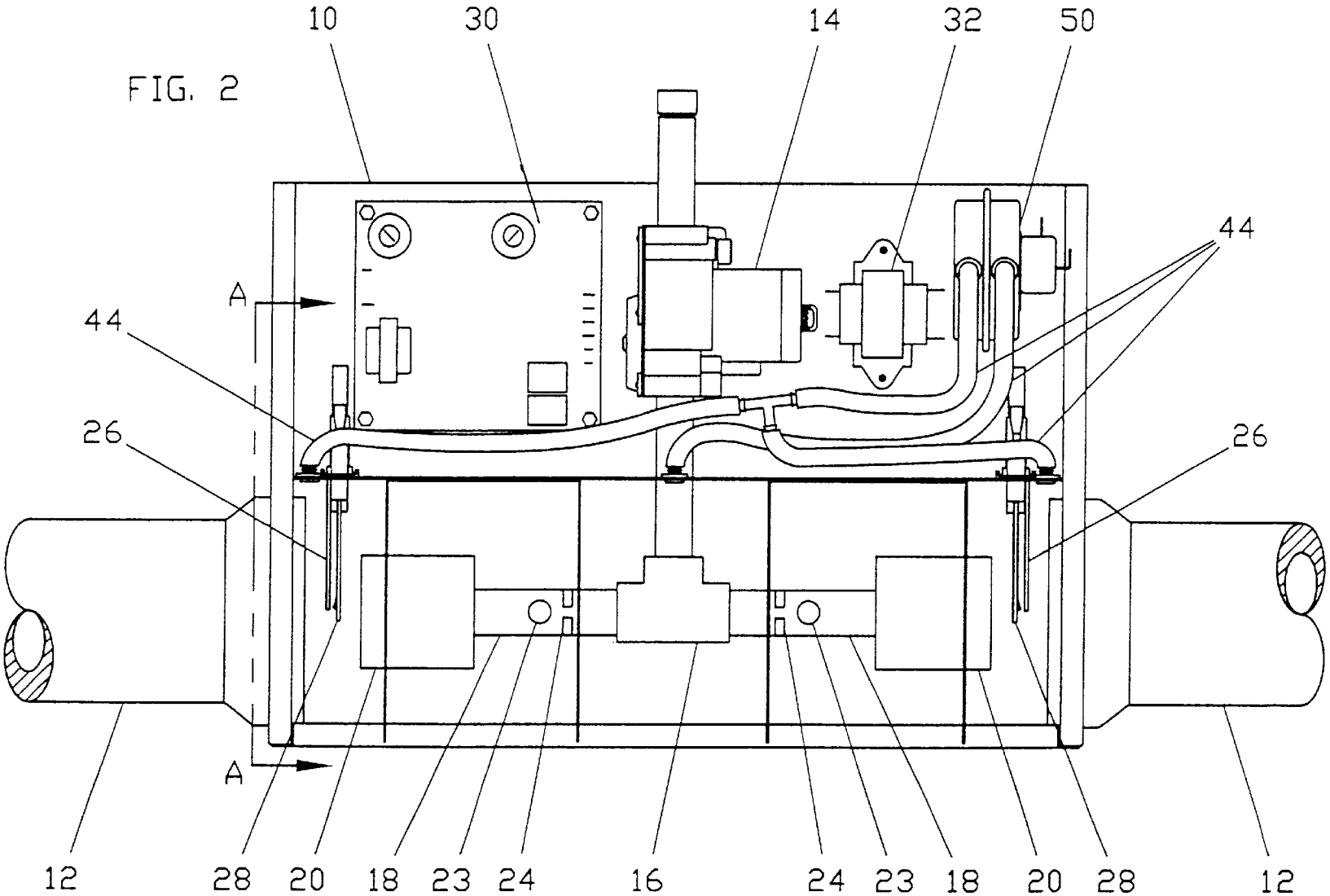
FIG. 2 is a side cutaway view of the housing shown in FIG. 1.
Figure 3:
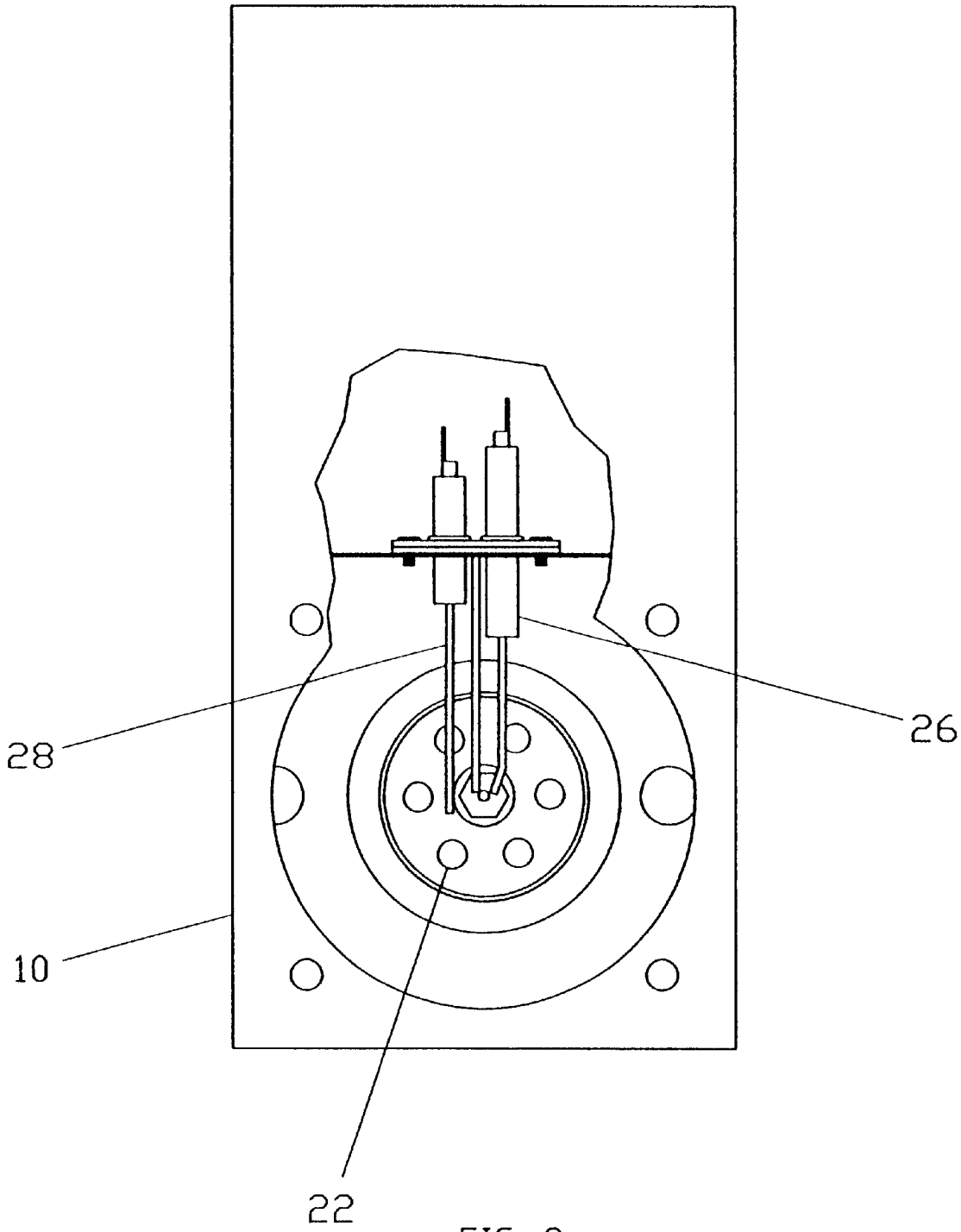
FIG. 3 is a sectional view taken generally along the line A—A showing the flame igniter and the flame sensor.
Figure 4:
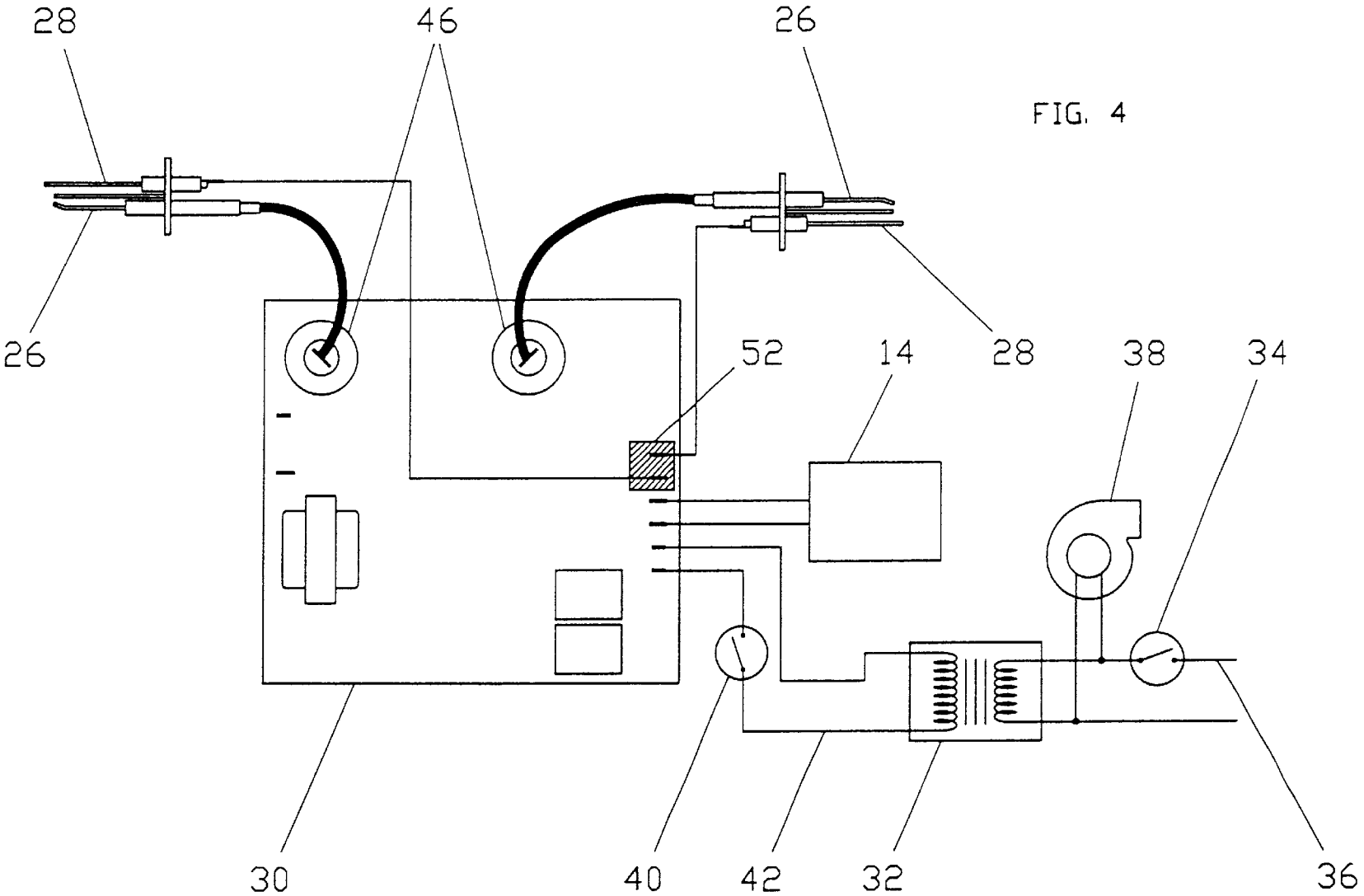
FIG. 4 is a somewhat schematic view of the electrical controls, including the control circuit board module shown in FIG. 2.
Figure 5:
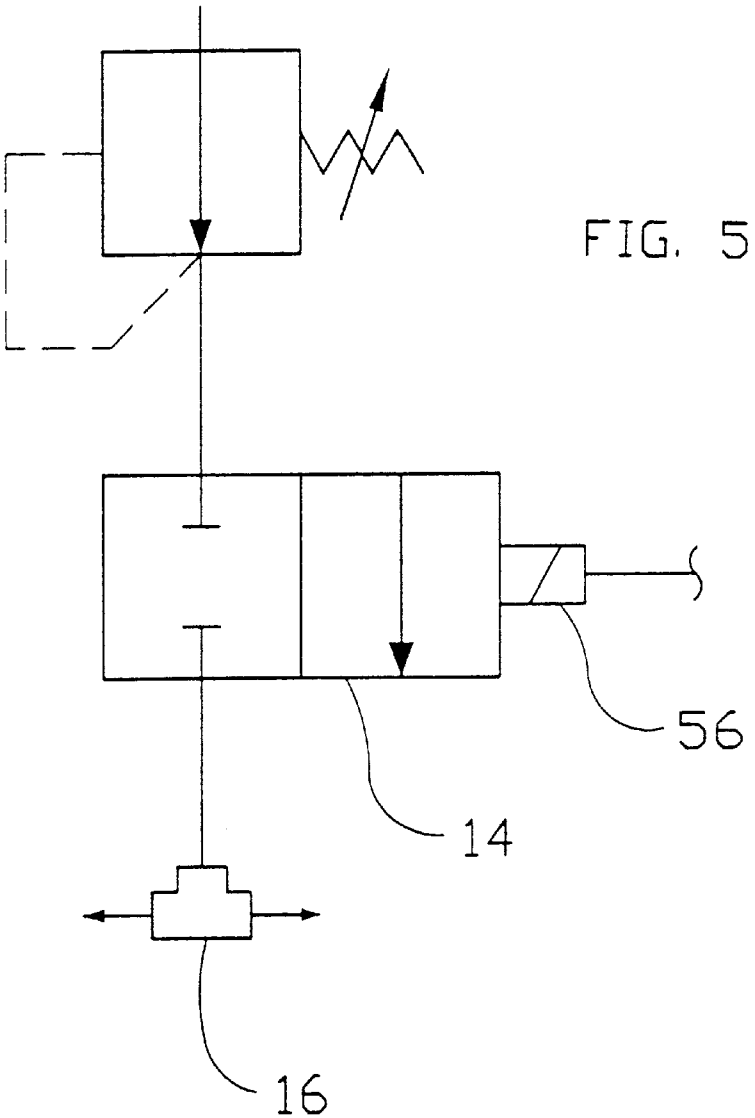
FIG. 5 is a schematic view of the gas valve.

As shown in FIG. 2, each of the outlets of the manifold is connected to a burner assembly 18. Each burner assembly includes a cup 20 having suitable apertures 22, an apertured stem 23, connected to a gas pipe 24 provided with a suitable orifice, the gas pipe being connected to the outlet of the manifold. Mounted downstream of each burner assembly 18, but upstream of the associated heat exchanger 12, is a flame igniter 26, and a flame sensor 28 best shown in FIG. 3. In accordance with this invention, the single gas delivery system includes a single control circuit module or circuit board 30 for controlling the operation of the valve 14, as well as other components. The circuit board 30 receives its power from a transformer 32 which is also mounted within the housing 10. As is conventional, a thermostatically controlled relay 34 (FIG. 4) is positioned in a power line 36 to a source of electricity, such as a 120 volt power line (not shown). A fan 38 (which is an exhaust fan in the FIG. 1 embodiment, but a blower in the FIGS. 6 and 7 embodiments) is provided for causing a flow of air through the burner assemblies 18 and through the radiant tubes 12 and into suitable exhaust stacks 48. The fan 38 will be operated when the relay switch 34 is closed. A normally open switch 40 is mounted in one of the power lines 42 which extends between the circuit board 30 and the transformer 32, the switch being responsive to blower proving switches 50 responsive to pressure (in the FIG. 6 embodiment) or to vacuum (in the FIG. 1 embodiment) in pressure lines 44. The circuit board or control circuit module 30 is provided with suitable spark generators 46 for initiating spark to each flame igniter 26, there being a spark generator for each flame igniter. Each flame sensor 28 is in turn connected with a suitable control device 52 on the circuit board 30.

In operation, the heating system shown in the various figures is operated in a manner similar to other thermostatically controlled heating appliances. Thus, operation is initiated by a thermostat or other suitable control device which causes relay 34 to close. The combustion air fan 38 is energized and combustion air flow is proven through the means of a single (or multiple) pressure switch 50. After combustion air is proven, the control circuit module 30 will allow for a pre-purge period of 30–45 seconds. After this period, the multiple spark generators 46 are energized which cause the flame ignitors 26 to spark, and the gas valve 14 is opened via solenoid 56. Gas then flows through the manifold 16 to the burner assemblies 18. Gas is then mixed with combustion air in a combustion chamber and the mixed gas and air are ignited by the associated igniter 26. The fire (or flame) and associated flue gases are drawn along the radiant tube heat exchangers 12 under a negative pressure in the FIG. 1 embodiment to a common flue gas exhauster and stack 48. Thus, the heat of the fire and flue gases is transferred to the radiant tube heat exchanger 12. When the tubing temperature is higher than the ambient temperature, it will begin to radiate infrared energy. This energy is radiated from the radiant tube in all directions. A reflector (not shown) is placed above the top side of the radiant tube 12 to contain convective and radiant energy. The reflector then directs the radiant energy downward into the space below that is being heated.

This heater as described above can also be constructed with the combustion air blower positioned at the upstream side of the burner and mixing chamber as shown in FIG. 6. In this case the flame and hot flue gases from the burner assemblies are forced along the radiant tube heat exchanger under a positive pressure from a blower 38. Flue gases exit through a common exhaust stack 48 as shown in dotted lines or through separate stacks 48 shown in full lines.

While a single fan has been shown in the various figures, it should be appreciated that in a negative pressure system which employs an exhaust fan, such as shown in FIG. 1, it is possible to use two exhaust fans if the radiant tubes 12 do not come together. Thus, if the radiant tubes were straight, as shown in full lines in FIG. 6, and if the heating system was a negative pressure system, there would be one exhaust fan between each radiant tube heat exchanger and the associated exhaust stack 48.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A gas fired infrared radiant tube heating system for heating an indoor enclosed space; said system comprising:

a unitary burner housing;

two or more radiant tube heat exchangers adapted to be disposed within said enclosed space without an enclosure housing so that the radiant tube heat exchangers can heat the indoor space directly, each of said radiant tube heat exchangers having first and second ends, the first end of each of said radiant tube heat exchangers being connected to said burner housing, the radiant tube heat exchangers extending away from said burner housing;

two or more separate burner assemblies (18) carried within the common burner housing, there being one burner assembly (18) interconnected with each of the radiant tube heat exchangers (12), each burner assembly having its own igniter and being capable of igniting and firing an associated radiant tube heat exchanger (12); and a single gas delivery system (14, 16, 30) mounted within the burner housing and connected to a source of combustible gas, the single gas delivery system being interconnected with the two or more separate burner assemblies (18).

2. The gas fired infrared radiant tube heating system as set forth in claim 1 wherein the single gas delivery system includes a single gas valve assembly (14).

3. The gas fired infrared radiant tube heating system as set forth in claim 1 wherein the single gas delivery system includes a single manifold (16), the manifold having a single inlet and two or more outlets, and wherein each of the burner assemblies (18) is connected to one of the two or more outlets of the single manifold.

4. The gas fired infrared radiant tube heating system as set forth in claim 1 wherein the single gas delivery system further includes a single control circuit module (30) mounted within the burner housing, the control circuit module monitoring ignition and operation of each of the burner assemblies, and controlling the gas delivery.

5. The gas fired infrared radiant tube heating system for heating an enclosed space as set forth in claim 1 further characterized by the combination of a single fan (38) used to force flame through the two or more radiant tube heat exchangers (12).

6. The gas fired infrared radiant tube heating system as set forth in claim 1 wherein the single gas delivery system further includes a single control circuit module (30) mounted within the burner housing, the control circuit module monitoring ignition and operation of each of the burner assemblies, and controlling the gas delivery; and a single fan (38) used to force flame through the two or more radiant tube heat exchangers (12), the operation of the fan (38) being controlled by the single control circuit module (30).

7. The gas fired infrared radiant tube heating system as set forth in claim 5 wherein the fan (38) is a exhaust fan.

8. The gas fired infrared radiant tube heating system as set forth in claim 7 wherein each of the radiant tube heat exchangers is connected at the second end to the exhaust fan (38).

9. The gas fired infrared radiant tube heating system as set forth in claim 5 wherein the fan (38) is a blower fan connected to the burner housing (10).

10. The gas fired infrared radiant tube heating system as set forth in claim 9 wherein each of the radiant tube heat exchangers (12) extends in a straight line away from the burner housing (10), each of the radiant tube heat exchangers being connected to a stack (48) at the second end.

* * * * *